US012710212B2

(12) United States Patent
Denson et al.

(10) Patent No.: US 12,710,212 B2
(45) Date of Patent: Aug. 18, 2026

(54) PORTABLE COOLER

(71) Applicant: Bison Coolers, LLC, Fort Worth, TX (US)

(72) Inventors: Jeremy Denson, Colleyville, TX (US); Tyler Willis Jennings, Hurst, TX (US)

(73) Assignee: Bison Coolers, LLC, Fort Worth, TX (US)

( * ) Notice: Subject to any disclaimer, the term of this patent is extended or adjusted under 35 U.S.C. 154(b) by 99 days.

(21) Appl. No.: 18/541,834

(22) Filed: Dec. 15, 2023

(65) Prior Publication Data

US 2025/0198682 A1 Jun. 19, 2025

(51) Int. Cl.

| | |
|---|---|
| ***F25D 3/08*** | (2006.01) |
| ***B65D 25/28*** | (2006.01) |
| ***B65D 43/16*** | (2006.01) |
| ***B65D 81/38*** | (2006.01) |

(52) U.S. Cl.

CPC ..... *F25D 3/08* (2013.01); *B65D 25/2841* (2013.01); *B65D 43/165* (2013.01); *B65D 81/3823* (2013.01); *B65D 2251/1058* (2013.01)

(58) Field of Classification Search

CPC ..... F25D 3/08; B65D 25/2841; B65D 43/165; B65D 81/3823; A45C 5/00

See application file for complete search history.

(56) References Cited

U.S. PATENT DOCUMENTS

| | | | | |
|---|---|---|---|---|
| 3,273,908 | A * | 9/1966 | Geiser, Jr. | B62B 3/00 280/79.2 |
| 4,437,676 | A * | 3/1984 | Kitrell | B62D 63/067 220/326 |
| 5,683,097 | A * | 11/1997 | Fenton | A45C 13/262 280/655.1 |
| 6,474,097 | B2 * | 11/2002 | Treppedi | F25D 3/08 280/30 |
| 7,143,601 | B1 * | 12/2006 | Jimenez | F25D 23/12 220/592.03 |
| 10,071,303 | B2 * | 9/2018 | Pikulski | A63C 17/016 |
| 2009/0139245 | A1 * | 6/2009 | Blackway | F25B 21/02 62/515 |

* cited by examiner

*Primary Examiner* — Shawn M Braden
(74) *Attorney, Agent, or Firm* — Whitaker Chalk Swindle & Schwartz PLLC; Decker A. Cammack

(57) ABSTRACT

A portable cooler comprises an insulated container formed by parallel opposing sides including front and back walls, first and second sides, and a lid and a floor, and handles attached to the front and rear walls. First and second wide-tread wheels disposed on an axle extending between the first and second sides of a wheel recess formed in the lower portion of the rear wall, wherein the wheels occupy substantially the entire space between the first and second sides. An alternate embodiment disposes a single, barrel-shaped wheel within the wheel recess. The cooler is especially adapted for rolling and maneuvering over uneven or very soft terrain.

20 Claims, 7 Drawing Sheets

PORTABLE COOLER

BACKGROUND OF THE INVENTION

1. Field of the Invention

The present invention relates to thermally insulated containers and more particularly to portable containers adapted to manually transporting perishable goods that must be kept cool over short distances for personal or business uses.

2. Background of the Invention

Insulated containers used for temporarily storing perishable food, beverages, ice, and biological organs or tissue samples are available in many sizes and configurations ranging from insulated boxes having rigid walls insulated with materials such as polystyrene or polyurethane foam products or other materials characterized by low thermal conductivity. Portable insulated containers or coolers are convenient for traveling or transporting perishable goods because of their low weight in proportion to their volume. Small containers are typically equipped with carrying handles, while larger sizes are designed to be pulled along on wheels. The lids of portable coolers may include edges formed to provide a frictional fit to secure the lid and seal it to resist leaks from external, and usually warmer, air. Other lids are equipped with positive latching mechanisms to secure the lid to the cooler body and ensure a leak-proof closure. Portable coolers may also be configured as insulated, reusable bags having flexible panels intended to be carried by hand to keep certain kinds of foods or liquids from absorbing too much heat during transport from store to home, for example.

Portable coolers equipped with wheels may include wheels placed at each corner of the cooler, enabling them to be puled along like a wagon. Such coolers may be well-adapted to transporting relatively heavy loads. However, four-wheeled coolers tend to be harder to maneuver unless the front wheels are configured to enable steering the cooler along a curved path. Four-wheeled coolers may also be inconvenient to store when not in use because the wheels necessarily protrude from the body of the cooler. An alternative design that eliminates the two front wheels enables the cooler to be towed more readily but retains the difficulties of inconvenient storage because of the placement of the wheels when numerous coolers are stacked for shipment from manufacturer to distributor to warehouse or retailer.

One popular use of portable coolers is for transporting foods and refreshments for picnics or tailgating, often packed in ice, from a personal vehicle to a site selected for a picnic, for example in a state or city park, a beach, or a tailgating site or stadium at an athletic or other event attended by fans or members of the event sponsor. Portable coolers intended for such use need to have low weight in proportion to volume plus be highly maneuverable because they may be towed for some distance over widely varying types of terrain or surfaces. Conventional two-wheeled coolers are often not well-suited to such use because of maneuverability that may be suitable for smooth, hard surfaces but poorly adapted to rough or rocky terrain, or soft surfaces that are difficult to walk on, let alone tow a cooler full of food and beverages, ice, etc.

There is thus a need for a portable cooler that overcomes the problems of towing or pulling a loaded or empty cooler for more than a few yards over uneven, rough, or soft terrain, so that the cooler remains stable and unlikely to tip over, possibly spilling its contents or other calamity.

SUMMARY OF THE INVENTION

In one embodiment, a portable cooler is disclosed, comprising an insulated container formed by parallel opposing sides including front and back walls, first and second sides, and a lid and a floor; a first handle pivotally attached to the front wall of the container; a wheel recess formed in the lower portion of the rear wall of the container between the first and second sides of the container; and first and second wheels disposed on an axle extending between the first and second sides of the wheel recess; wherein the first and second wheels are configured with a wide tread profile such that when disposed side-by-side on the axle the wheels occupy substantially the entire space between the first and second sides.

In other aspects, the wide tread profiles of the first and second wheels include a textured tread surface to enable rolling without skidding while being towed along a surface; and the first and second wheels rotate independently on the axle, such that one wheel freely rotates along an arc while the other wheel may pivot in place when the portable cooler is being turned along its path.

In other aspects, the axle is positioned within the wheel recess between the first and second sides of the container such that the treads of the first and second wheels extend slightly below the bottom surface of the portable cooler or extend slightly aft of the outer surface of the rear panel of the portable cooler.

In another aspect, the wide tread profile of the first and second wheels allow the portable cooler to roll across a deep sand surface without sinking.

In another aspect the wheel recess is fully separated from the interior of the portable cooler by a partition between the wheel recess and the interior of the portable cooler.

In another embodiment, a portable cooler is disclosed, comprising an insulated container formed by parallel opposing sides including front and back panels, first and second sides, and a lid and a floor panel; a wheel recess formed in the lower, rear portion of the container between the first and second sides of the container; and first and second wheels each configured with a wide tread profile and disposed on a common axle within the wheel recess between the first and second sides.

In another embodiment, a portable cooler is disclosed, comprising an insulated container formed by parallel opposing sides including front and back panels, first and second sides, and a lid and a floor panel; a wheel recess formed in the lower, rear portion of the container between the first and second sides of the container; and a barrel-shaped wheel configured with a wide tread profile and disposed on an axle within the wheel recess between the first and second sides.

DETAILED DESCRIPTION OF THE INVENTION

In an advance in the state of the art, a portable cooler is described that incorporates a combination of features heretofore not present in portable, wheeled coolers to provide adaptability to a wide variety of personal and business uses. In addition to handles attached or built in to the front and rear ends of the insulated container body, the wheels inset into the lower, rear corner of the body are configured for ease of use when being towed by the extended front handle over a wide variety of terrain such as paved surfaces, unpaved surfaces, bare ground, rocky surfaces, and soft terrain such as beach sand, lawn grass, etc.

The portable cooler design described herein provides several advantages including the following. (1) The wide-tread wheels roll easily over soft and uneven terrain such as sandy beaches and off-road campsites, etc. (2) The wheels are inset in a respective recess of the cooler body so that it remains stable on a flat surface during use, or whether stacked upright or on end. (3) The flat floor of the cooler body, which is parallel with the top of the cooler, allows maximum rectangular interior space and enables easier stacking of the cooler during transport and storage. (4) The wheels are positioned between the lower, rear corners of the side walls to ease storage. (5) The wheels extend just enough from the rear wall/floor of the container, i.e., the lower rear corner so that the cooler is easy to roll when the front end is raised to pull it along by the handle.

In the following description the structures and components of an embodiment of the invention are identified by reference numbers appearing in multiple views. FIGS. 1 through 5 illustrate various views of the portable cooler to depict the relationships among the components.

Figure 6:
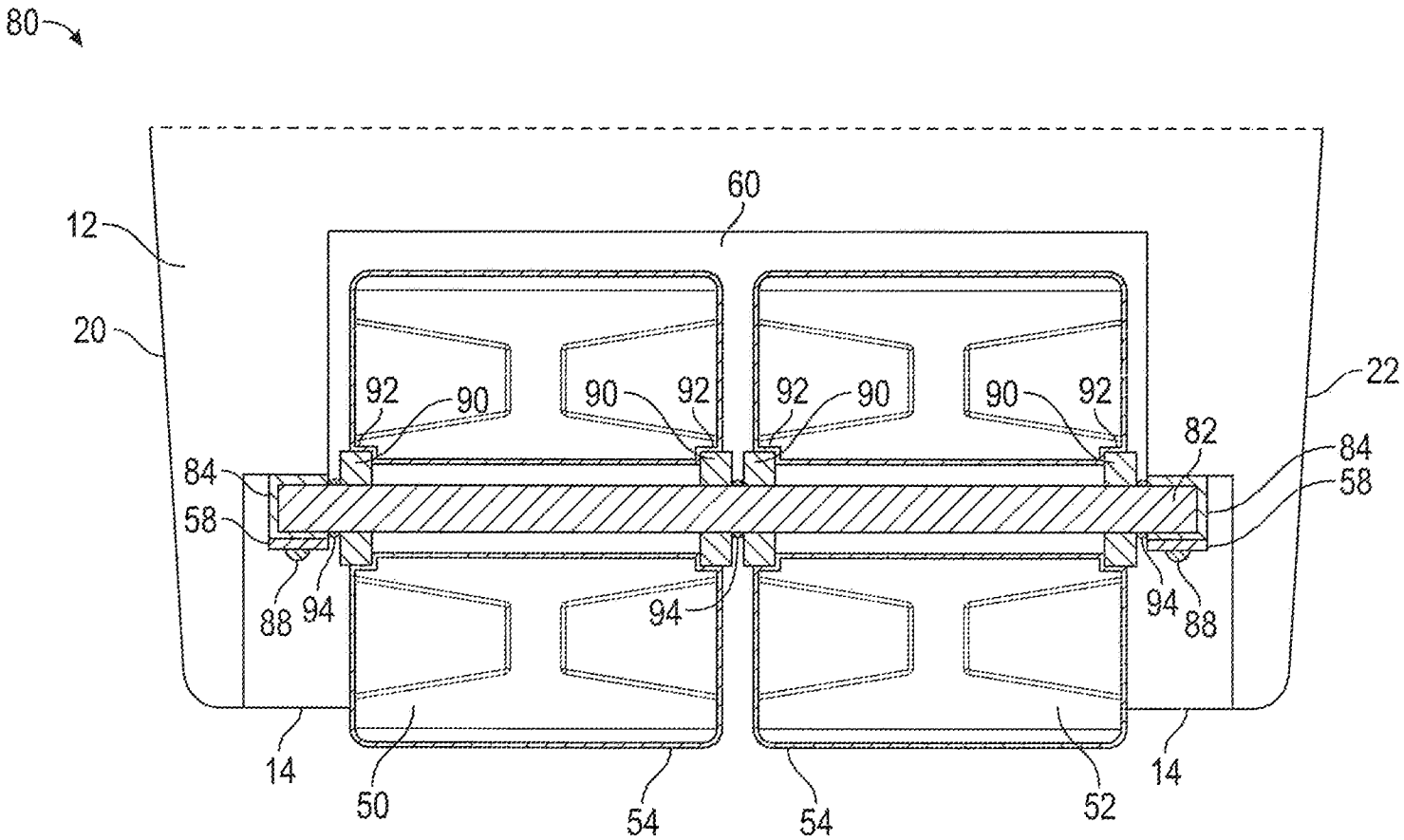
FIG. 6 is a cross section view of the two-wheel embodiment depicted in FIGS. 1-4.
Figure 7:
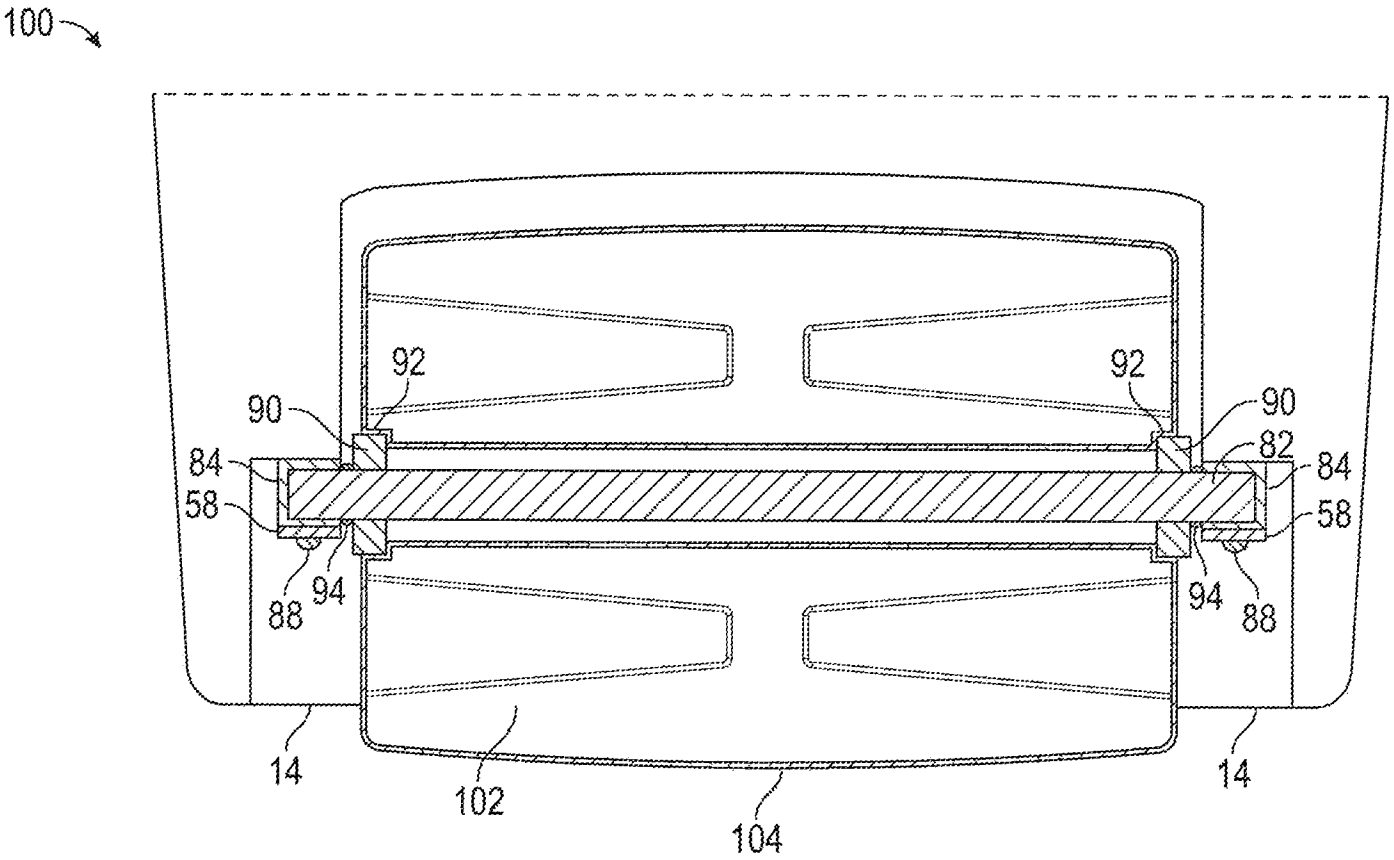
FIG. 7 is a cross section view of a single-wheel alternate embodiment of the portable cooler depicted in FIGS. 1-4.

FIGS. 6 and 7 illustrate two alternate embodiments of the wheels that enable the cooler to be easily towed and rolled along a wide variety of surfaces.

Figure 5:
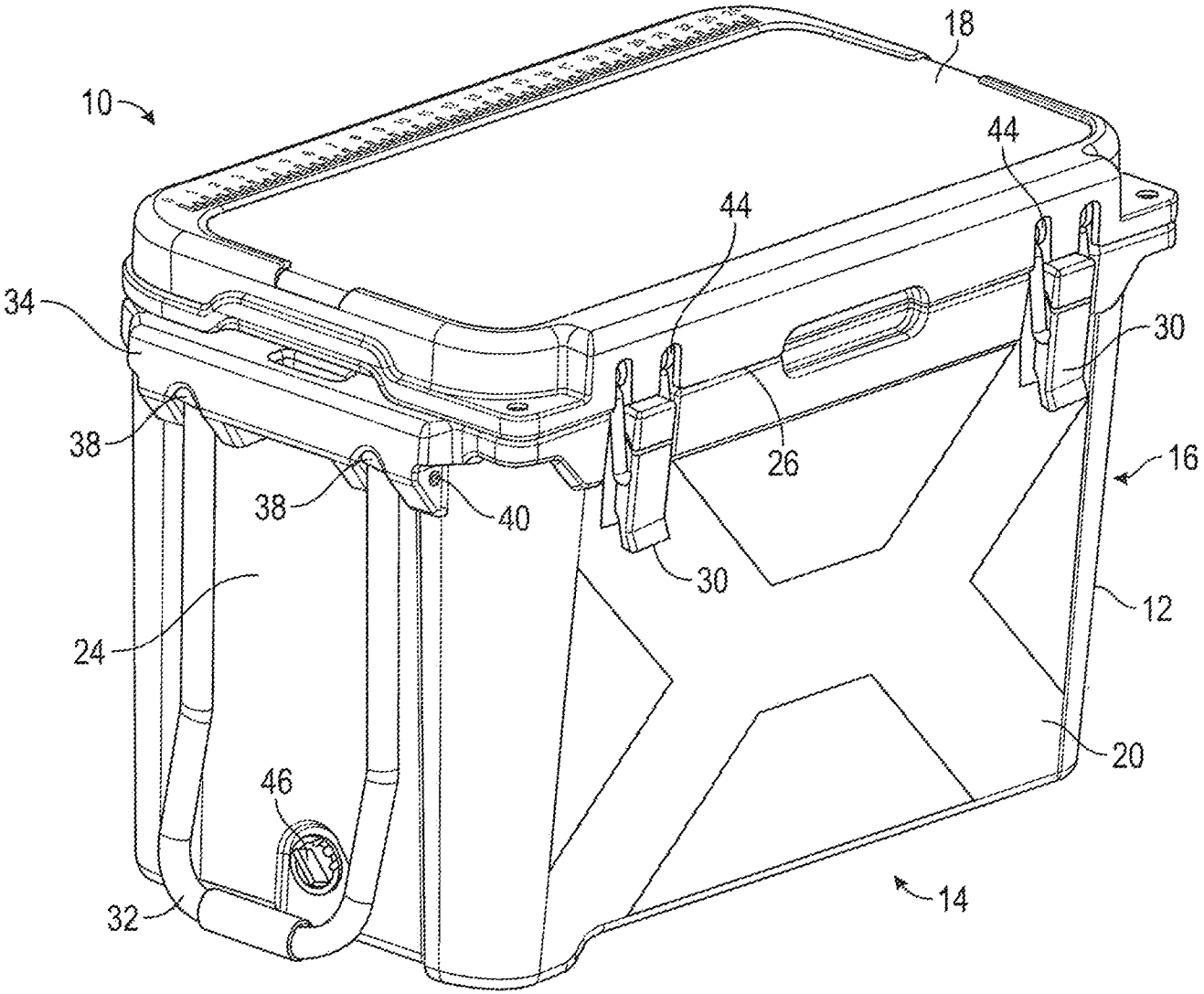
FIG. 5 is a perspective view of the embodiments depicted in FIGS. 1-4.

Perspective views of a preferred embodiment of a portable cooler 10 are shown in FIGS. 1, 2, 4 and 5. The cooler body 12 includes a bottom panel 14, a rear panel 16, a top side lid 18, first and second sides 20, 22, and a front panel 24. The body 12 may be a composite structure including polyethylene exterior and interior shells that enclose an insulating layer of polyurethane foam. The lid 18 intersects the body 12 along a formed top edge 26 of the body 12 (FIG. 5). The lid 18 pivots on hinge pins 36 along the top edge 26 of second side 22 and may be secured by cantilever latches 30 along the formed top edge 26 of the first side 20 (see FIGS. 1 through 5).

Figure 1:
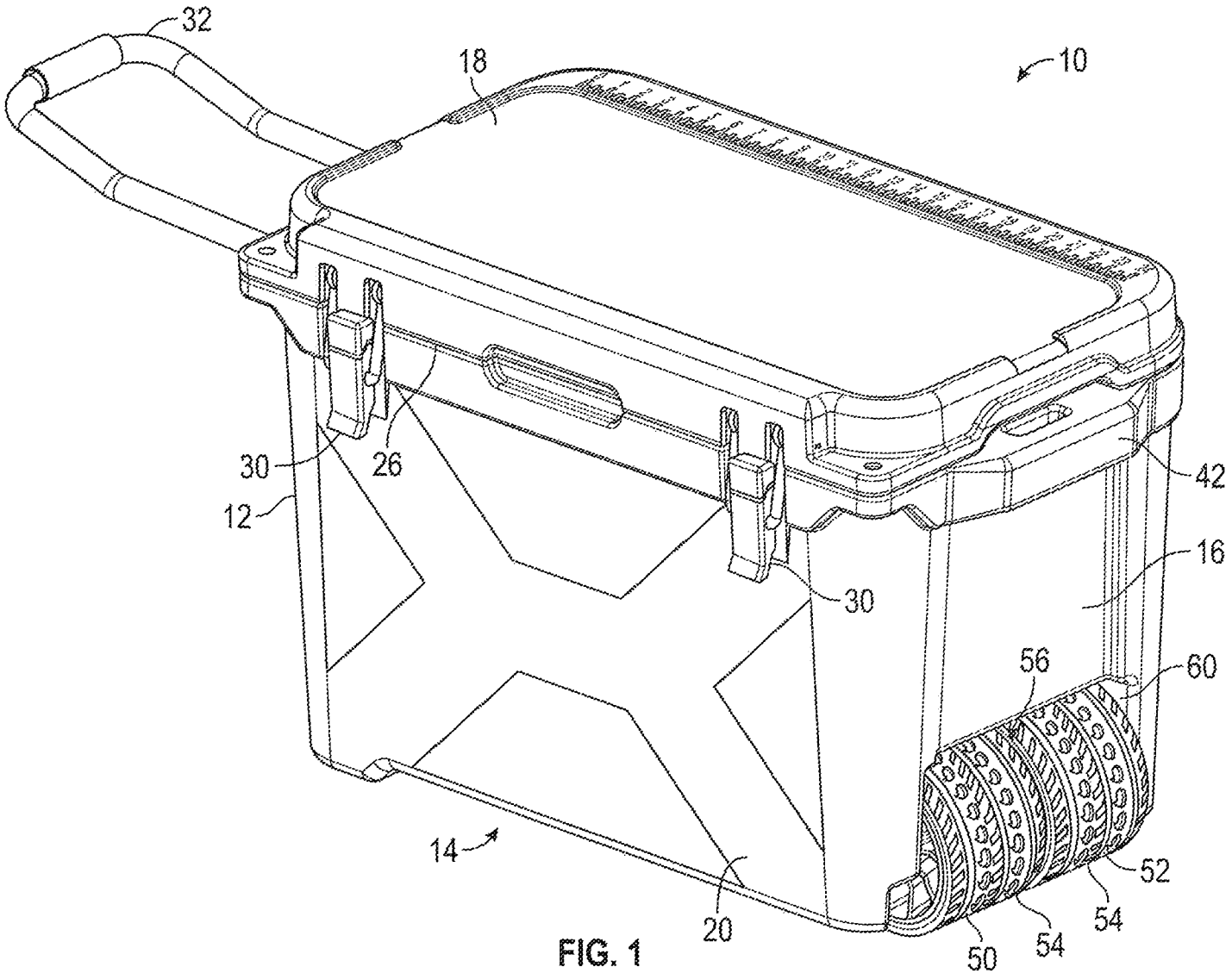
FIG. 1 is a perspective view of a preferred embodiment of the claimed invention.
Figure 2:
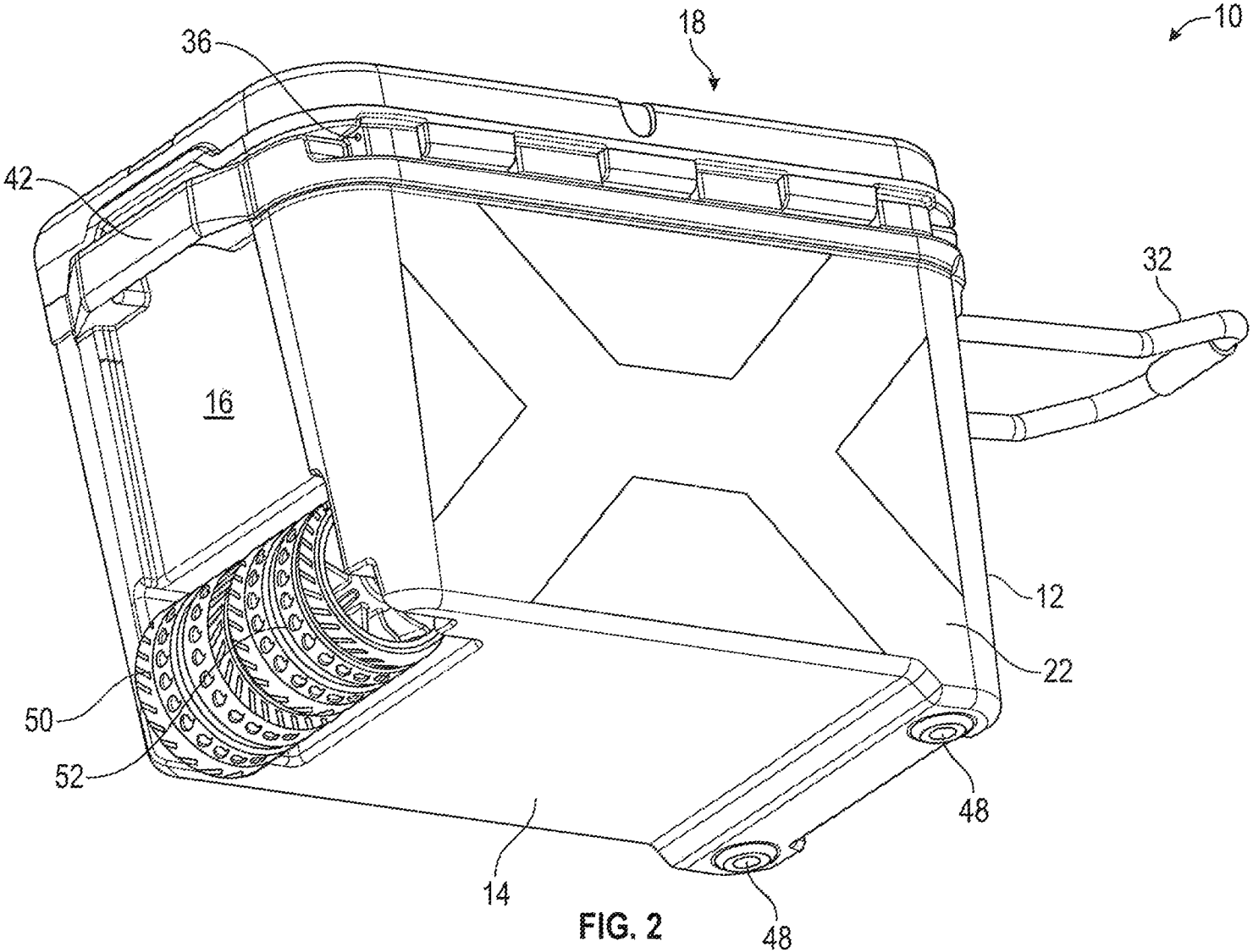
FIG. 2 is a perspective view of the embodiment depicted in FIG. 1 from a different angle.
Figure 3:
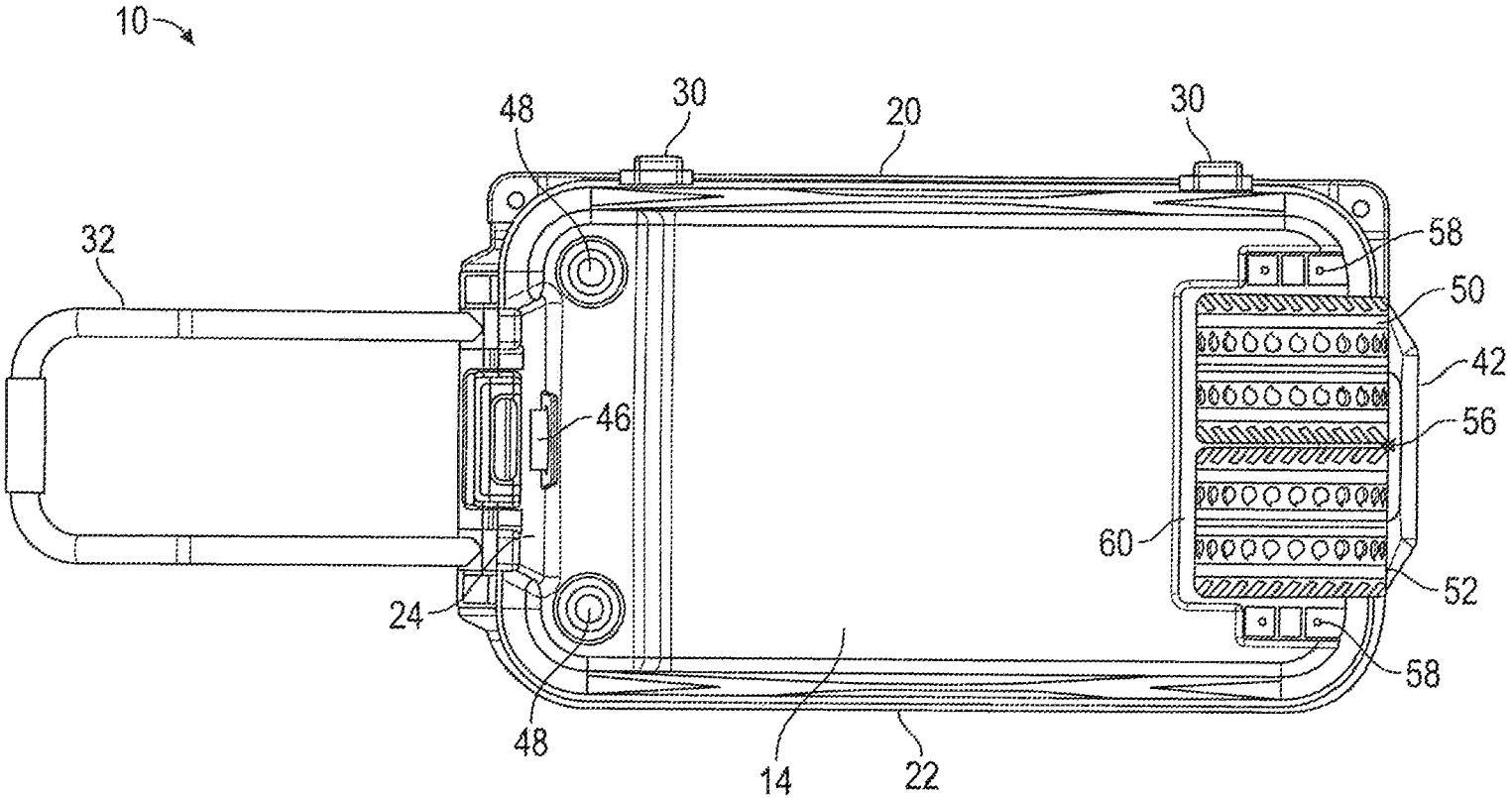
FIG. 3 is a view of the underside of the embodiment depicted in FIG. 1.
Figure 4:
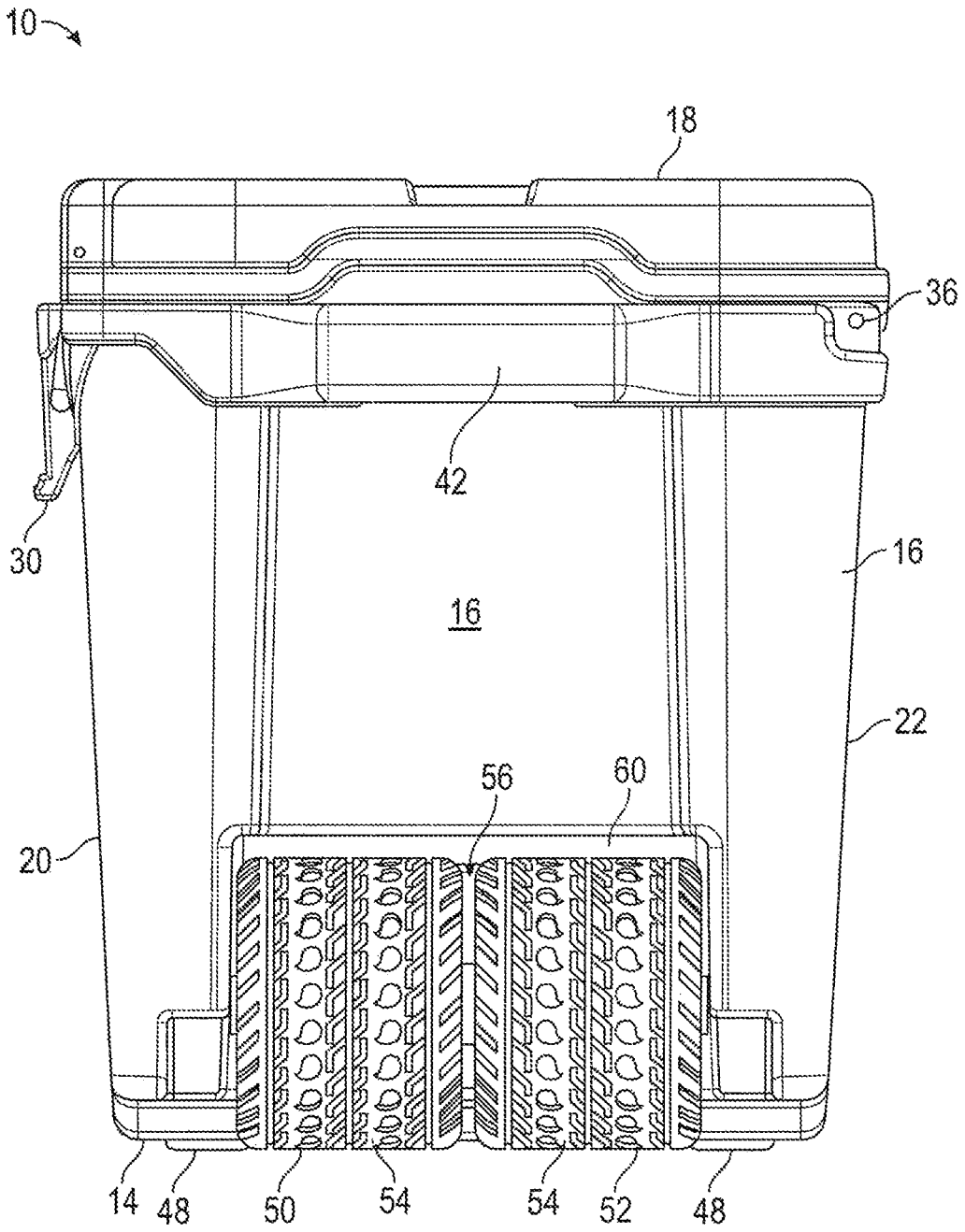
FIG. 4 is a rear view of the embodiment depicted in FIG. 1.

The cooler 10 includes a U-shaped front handle 32 attached by pivots 38 at each open end of the handle 32 to the front panel 24. The pivots 38 are disposed in a handle support 34 molded into the front panel 24. The pivots 38 rotate on a pivot shaft 40 that passes through the handle support 34 located near the top of the front end 24. The cooler further includes a fixed rear handle 42 molded into the top of the rear panel 16 (see FIGS. 1 through 5). A drain plug 46 and a rubber seal (not shown) are inset into the lower end of the front panel 24 as shown in FIGS. 3 and 5.

The rectangular body 12 of the portable cooler allows for stacking multiple units as in shipping or storing. Stacking the units is facilitated by substantially recessing the wheels 50, 52 (FIG. 6) or 102 (FIG. 7) into the lower, rear corner of the body 12. The wheel treads 54 (FIG. 6) or 104 (FIG. 7) are positioned slightly past the bottom and rear panels to enable ease of rolling and maneuverability as will be described. When the units are stacked on the rear panel, the extension of the rear wheels is matched by the protrusion of the fixed rear handle 42, which acts as a foot to dispose the cooler in a fully upright position when stacked on its rear end.

Referring to FIGS. 1 through 4, there is illustrated an innovation in the wheel design of the portable cooler 10. As discussed in the background of the invention, one popular use of portable coolers is for transporting picnic foods and refreshments, often packed in ice, from a personal vehicle to a site selected for the picnic, for example in a state or city park, or a tailgating site or stadium at an athletic or other event attended by fans or members of the event sponsor. Portable coolers intended for such use need to be highly maneuverable because they may be towed by hand for some distance over widely varying types of terrain or surfaces. Conventional four-wheeled or two-wheeled coolers are often not well-suited to such use over rough or rocky terrain, or soft surfaces that are difficult to walk on, let alone tow a cooler full of food, beverages, and ice, for example.

Thus, to provide a portable cooler that overcomes the problems of towing or pulling a loaded or empty cooler for more than a few yards over uneven, rough, or soft terrain, the wheel configurations illustrated and described herein solve the maneuverability problem and improves the stability and handling ease of the portable cooler. In a preferred embodiment 80 illustrated in FIG. 6, first 50 and second 52 wheels are shown disposed partially within a recess 60 into the lower, rear portion of the body 12 of the cooler. The first 50 and second 52 wheels are supported on an axle 82 in a cutaway view along a centerline of the axle 82. The axle 82 may be supported in the body 12 of the cooler 10 in a receptacle 84 at each end of the axle 82. The receptacles 84 may be fixed to the body 12 by clamps 58 and secured by screws 88. The clamps 58 may be flat strips of metal or plastic as also depicted in FIG. 3. The first 50 and second 52 wheels preferably rotate on bearings 90, each installed in a respective hub 92 formed in the center of each side of each wheel 50, 52 and disposed along the axle 82. Each first 50 and second 52 wheel may preferably include a tread 54 formed into or applied on to the rolling surface of the wheel to improve traction. The tread 54 may be molded integrally with the wheels; or alternately formed of a rubber material or its equivalent and installed as a separate component on each wheel.

As thus configured in FIG. 6, the first 50 and second 52 wheels rotate independently on the single axle 82. It is to be noted that the wheels 50, 52 have a very wide tread in proportion to their diameter, thereby providing a large footprint area to enable rolling over soft terrain such as sandy beaches, grassy lawns, etc. This configuration is also advantageous when the portable cooler is rolled along uneven or rocky terrain and is especially apparent when the cooler 10 is pulled along a curved path, where one wheel is nearly stationary while the other wheel is rotating along the path. This configuration minimizes the amount of drag imparted to the wheels, thus enhancing the stability and ease of rolling along the desired path.

An alternate embodiment 100 of the wheel design shown in FIG. 7 comprises a single, barrel-shaped wheel 104, which may be constructed in the same manner and of the same materials for both the wheel 102 and its tread 104 as described above for the embodiment of FIG. 6. The barrel shape, where the diameter midway between the ends of the wheel 102 is slightly larger—for example, up to approximately 3% larger—than the diameter at the ends of the wheel 102, provides a similar maneuverability advantage on a variety of terrains. The wide diameter center portion permits the barrel-shaped wheel 102 to pivot easily on a small footprint when negotiating a corner or curved path. Further, the relatively large width of the single wheel 102 permits the wheel to spread the weight of the load in the cooler 10 over a relatively large footprint, which facilitates towing the cooler 10 over soft and loose terrain such as found on a beach. Installation of the alternate embodiment wheel design of FIG. 7 is essentially the same as described for FIG. 6. In fact, the two alternatives illustrated in FIGS. 6 and 7 are basically interchangeable provided the dimensions and configuration of the body 12 of the portable cooler are the same.

In FIGS. 6 and 7, spacers 56 may be used between or next to the bearings 90 in either wheel configuration. The wheel spacers 56, bearings 90, and the pivot pin 40 for the front pull handle 32, may be formed of stainless steel. The lid hinge pins 36, the latch pins (not visible in the Figures but embedded in the lid 18), and the pull handle 32 may be formed of aluminum. The cantilever latches 30, seals for the drain plug 46 (not shown) and the feet 48 may be formed of a hard rubber material.

While the invention has been shown and described in only a few of its forms, it is not thus limited but is susceptible to various changes and modifications without departing from the spirit thereof. For example, the first and second wheels in the embodiment having two wheels may be configured with a barrel-shaped profile as described herein. Other modifications include tread patterns that differ from those illustrated in the drawings.

What is claimed is:

1. A portable cooler, comprising:

an insulated container formed by substantially parallel opposing first and second sides, front and back panels, a lid and a floor panel;

a wheel recess formed in a lower, rear portion of the insulated container between the first and second sides of the insulated container; and first and second wheels disposed on an axle extending between the first and second sides of the insulated container; wherein the first and second wheels are configured such that when disposed side-by-side on the axle the wheels occupy substantially the entire space between the first and second sides.

2. The portable cooler of claim 1, wherein:

the first and second wheels are configured with a wide tread profile having a textured tread surface to enable rolling without skidding while being towed along a surface.

3. The portable cooler of claim 1, wherein:

the axle is positioned within the wheel recess between the first and second sides of the insulated container such that the treads of the first and second wheels extend slightly below the floor panel of the insulated container.

4. The portable cooler of claim 1, wherein:

the first and second wheels rotate independently on the axle, such that one wheel freely rotates along an arc while the other wheel may pivot in place when the insulated container is being turned along its path.

5. The portable cooler of claim 1, wherein:

the wide tread profile of the first and second wheels allow the first and second wheels to roll across a deep sand surface without sinking.

6. The portable cooler of claim 1, wherein:

the wheel recess is fully separated from the interior of the insulated container by a partition formed in the floor panel between the wheel recess and the interior of the insulated container.

7. The portable cooler of claim 1, wherein:

a first, U-shaped handle is pivotally attached to the front wall of the insulated container.

8. The portable cooler of claim 7, comprising:

a second handle formed into the rear surface of the portable cooler just below the lid and extending slightly from the rear surface to enable lifting the rear end of the insulated container and provide a foot when the portable cooler is stacked on its rear end.

9. The portable cooler of claim 1, wherein:

The insulated container is constructed of a polyurethane foam body disposed between interior and exterior shells of molded polyethylene material.

10. The portable cooler of claim 1, wherein:

the first and second wheels are molded of polyethylene material.

11. A portable cooler, comprising:

an insulated container formed by substantially parallel opposing first and second sides, front and back panels, and a lid and a floor panel;

a wheel recess formed in a lower, rear portion of the insulated container between the first and second sides of the insulated container; and a wheel configured with a wide tread profile and disposed on an axle within the wheel recess between the first and second sides of the insulated container.

12. The portable cooler of claim 11, wherein:

wherein the axle is positioned within the wheel recess between the first and second sides of the insulated container such that the wheel extends slightly below the floor panel of the insulated container.

13. The portable cooler of claim 11, wherein:

a first, U-shaped handle is pivotally attached to the front wall of the insulated container.

14. The portable cooler of claim 13, comprising:

a second handle formed into the rear surface of the insulated container just below the lid and extending slightly from the rear surface to enable lifting the rear end of the portable cooler and provide a foot when the insulated container is stacked on its rear end.

15. The portable cooler of claim 11, wherein:

the insulated container is constructed of a polyurethane foam body disposed between interior and exterior shells of a molded polyethylene material.

16. The portable cooler of claim 11, wherein:

the wheel is molded of polyethylene material.

17. A portable cooler, comprising:

an insulated container formed by parallel opposing sides including front and back panels, first and second sides, and a lid and a floor panel;

a wheel recess formed in a lower, rear portion of the insulated container between the first and second sides of the insulated container; and a barrel-shaped wheel disposed on an axle within the wheel recess between the first and second sides of the insulated container.

18. The portable cooler of claim 17, wherein:

the axle is positioned within the wheel recess between the first and second sides of the container; and the barrel-shaped wheel includes a textured tread surface to enable rolling without skidding while being towed along a surface.

19. A portable cooler, comprising:

an insulated container formed by parallel opposing sides including front and back panels, first and second sides, and a lid and a floor panel;

a wheel recess formed in a lower, rear portion of the insulated container between the first and second sides of the insulated container; and first and second wheels disposed on an axle extending between the first and second sides of the wheel recess; wherein the first and second wheels are configured with a wide tread profile such that when disposed side-by-side on the axle the wheels occupy substantially the entire space between the first and second sides, and wherein the axle is positioned within the wheel recess between the first and second sides of the container such that the treads of the first and second wheels extend slightly aft of the outer surface of the rear panel of the portable cooler.

20. A portable cooler, comprising:

an insulated container formed by parallel opposing sides including front and back panels, first and second sides, and a lid and a floor panel;

a wheel recess formed in a lower, rear portion of the container between the first and second sides of the container; and a wheel first and second wheels each configured with a wide tread profile and disposed on an axle within the wheel recess between the first and second sides of the insulated container, wherein the axle is positioned within the wheel recess between the first and second sides of the container such that the tread of the barrel-shaped wheel extends slightly aft of the outer surface of the rear panel of the insulated container.

* * * * *